US007556210B2

(12) United States Patent
Mandell et al.

(10) Patent No.: US 7,556,210 B2
(45) Date of Patent: Jul. 7, 2009

(54) SELF-CONTAINED MULTI-SPRAYER

(75) Inventors: Jonathan N. Mandell, Gurnee, IL (US); Kenneth R. Waeber, Loveland, OH (US); Dirk K. Nickel, Mukwonago, WI (US); Donald J. Schumacher, Racine, WI (US); James W. Yonker, Racine, WI (US); Eric M. Luther, West Chester, OH (US); Shannon R. Read, Lebabon, OH (US); Clinton A. Haynes, Mason, OH (US); Todd J. Bucholz, Maineville, OH (US)

(73) Assignee: S. C. Johnson & Son, Inc., Racine, WI (US)

( * ) Notice: Subject to any disclaimer, the term of this patent is extended or adjusted under 35 U.S.C. 154(b) by 371 days.

(21) Appl. No.: 11/382,845

(22) Filed: May 11, 2006

(65) Prior Publication Data

US 2007/0264138 A1 Nov. 15, 2007

(51) Int. Cl.

| | |
|---|---|
| ***B05B 9/00*** | (2006.01) |
| ***B05B 9/06*** | (2006.01) |
| ***A62C 13/62*** | (2006.01) |
| ***A62C 11/00*** | (2006.01) |
| ***B05B 7/12*** | (2006.01) |

(52) U.S. Cl. ..... 239/158; 239/147; 239/155; 239/304; 239/310; 239/331; 239/413

(58) Field of Classification Search ..... 239/147, 239/155, 157, 158, 303, 304, 308, 310, 316, 239/331, 407, 412, 413

See application file for complete search history.

(56) References Cited

U.S. PATENT DOCUMENTS

| | | | |
|---|---|---|---|
| 145,572 | A | 12/1873 | Johnson |
| 147,442 | A | 2/1874 | Steiner |
| 233,431 | A | 10/1880 | Pinter |
| 258,233 | A | 5/1882 | Kauffer |
| 346,872 | A | 8/1886 | Simon |
| 444,786 | A | 1/1891 | Tyrrel |
| 510,287 | A | 12/1893 | Peppler |
| 548,697 | A | 10/1895 | Caswell |
| 668,007 | A | 2/1901 | Capps |
| 674,701 | A | 5/1901 | Kelso |
| 679,262 | A | 7/1901 | Kelso |

(Continued)

FOREIGN PATENT DOCUMENTS

| | | |
|---|---|---|
| DE | 26 11 701 | 9/1977 |

(Continued)

OTHER PUBLICATIONS

International Search Report and Written Opinion for PCT/US2007/011312 dated Nov. 5, 2007.

*Primary Examiner*—Len Tran
*Assistant Examiner*—Ryan Reis

(57) ABSTRACT

A pressure sprayer includes an accumulator vessel adapted to hold a pressurized fluid therein and a container that is configured to hold a chemical concentrate. A motor in fluid communication with the accumulator vessel and the container is adapted to be driven by the pressurized fluid and to pump the pressurized fluid and the chemical concentrate. A chamber is adapted to receive the chemical concentrate and the pressurized fluid from the motor to form a chemical solution. A nozzle is in fluid communication with the chamber.

19 Claims, 11 Drawing Sheets

U.S. PATENT DOCUMENTS 687,396 A 11/1901 Dunn et al.
699,292 A 5/1902 Doerr
746,953 A 12/1903 Gill
802,564 A 10/1905 Hall
817,813 A 4/1906 Splittstoser
855,496 A 6/1907 Barber
918,490 A 4/1909 Aitken
920,520 A 5/1909 Barber
969,217 A 9/1910 Stewart
1,047,452 A 12/1912 Schottgen
1,069,767 A 8/1913 Clarke
1,073,646 A 9/1913 Thompson
1,162,565 A 11/1915 Buffat
1,261,101 A 4/1918 Clark
1,339,382 A 5/1920 Barber
1,374,274 A 4/1921 Barrett
1,387,352 A 8/1921 Clark
1,495,506 A 5/1924 Debnam et al.
1,498,608 A 6/1924 Bishop
1,648,154 A 11/1927 Steiger
1,749,326 A 3/1930 Dirkes et al.
1,767,072 A 6/1930 Honn
2,013,370 A 9/1935 Tygart
2,048,063 A 7/1936 Friedman
2,162,057 A 6/1939 Brandt et al.
2,199,110 A 4/1940 Metz
2,227,222 A 12/1940 Henderson
2,252,872 A 8/1941 Spreng
2,357,141 A 8/1944 Singleton
2,456,019 A 12/1948 Pettipiece
2,491,818 A 12/1949 Lapp
2,513,455 A 7/1950 Cornelius
2,604,230 A 7/1952 Payne
2,612,215 A 9/1952 Edwards
2,703,256 A 3/1955 Mascaro
2,721,437 A 10/1955 Greenlund
3,473,480 A 10/1969 Kollmai
3,601,314 A * 8/1971 Hurt ..... 239/157
3,625,256 A 12/1971 Smith
3,847,182 A 11/1974 Greer
3,893,627 A 7/1975 Siczek et al.
4,087,048 A 5/1978 Smrt
4,167,941 A 9/1979 Capra et al.
4,177,926 A 12/1979 Hunter
4,197,994 A * 4/1980 Liedberg ..... 239/61
4,227,649 A 10/1980 Poffenroth
4,333,609 A 6/1982 Backo
4,355,511 A 10/1982 Jones
4,403,738 A * 9/1983 Kern ..... 239/313
4,505,405 A * 3/1985 Kelly et al. ..... 222/135
4,508,248 A 4/1985 Ridgeon
4,638,948 A 1/1987 Marlek
4,650,124 A 3/1987 Connaughty et al.
4,697,739 A 10/1987 McCracken et al.
4,702,416 A 10/1987 Pagliai et al.
4,702,419 A 10/1987 Luchsinger
4,721,245 A 1/1988 van Zweeden
4,751,994 A * 6/1988 Brown et al. ..... 194/341
4,798,333 A 1/1989 Luchsinger
4,826,083 A 5/1989 Vanderjagt
4,936,096 A 6/1990 Vanderjagt
4,962,888 A 10/1990 Beccaria et al.
4,962,892 A 10/1990 Sauer
5,004,155 A 4/1991 Dashevsky
5,014,914 A 5/1991 Wallenas
5,072,884 A 12/1991 Ellison et al.
5,109,791 A 5/1992 Matsumoto et al.
5,195,308 A 3/1993 Grote et al.
5,307,995 A 5/1994 Jackson et al.
5,310,113 A 5/1994 Cowgur
5,335,853 A 8/1994 Wirz
5,433,380 A 7/1995 Hahn
5,445,324 A 8/1995 Berry et al.
5,562,234 A 10/1996 Su
5,613,371 A 3/1997 Nelson
5,671,884 A 9/1997 Restive
5,695,121 A 12/1997 Stillions, Jr. et al.
5,755,361 A 5/1998 Restive et al.
5,755,561 A 5/1998 Couillard et al.
5,836,519 A 11/1998 Brown
5,857,618 A 1/1999 Restive
5,878,926 A 3/1999 Schmidt et al.
5,899,362 A 5/1999 Moran
5,931,207 A 8/1999 Gianino
5,964,377 A 10/1999 Demarest et al.
5,979,793 A 11/1999 Louis
5,984,199 A 11/1999 Restive
6,047,902 A * 4/2000 Hofmann ..... 239/172
6,079,632 A 6/2000 Yan
6,125,879 A 10/2000 Prosper et al.
6,145,711 A 11/2000 Prosper et al.
6,158,669 A 12/2000 Louis
6,394,365 B1 5/2002 Jeanfreau
6,565,015 B2 * 5/2003 Leer et al. ..... 239/157
6,945,438 B1 9/2005 Shih et al.
6,957,669 B2 10/2005 Suzuki et al.
6,981,613 B1 1/2006 Kamisugi
2004/0084552 A1 5/2004 Huartson
2005/0077401 A1 4/2005 Sinden et al.
2005/0219302 A1 10/2005 Vogeley
2005/0225201 A1 10/2005 Vogeley

FOREIGN PATENT DOCUMENTS

DE 29 43 154 5/1980
DE 31 40 441 4/1983
DE 39 08 963 9/1990
DE 40 11 057 10/1991
DE 19948860 A1 4/2001
EP 0 178 065 4/1986
EP 0 456 876 11/1991
EP 0 887 111 12/1998
EP 1134029 A2 9/2001
FR 1 428 494 8/1964
FR 2 315 228 1/1977
FR 2 668 400 4/1992
FR 2 790 923 9/2000
GB 2 060 784 5/1981
HU 50858 3/1990
JP 49-026813 3/1974
JP 50-134201 10/1975
JP 52-148813 12/1977
JP 54-083110 7/1979
JP 54-132812 10/1979
JP 55-003880 1/1980
JP 55-003881 1/1980
JP 55-003882 1/1980
JP 55-003883 1/1980
JP 55-006056 1/1980
JP 55-006057 1/1980
JP 55-006058 1/1980
JP 55-061954 5/1980
JP 55-064860 5/1980
JP 56-069965 6/1981
JP 56-084663 7/1981
JP 57-035956 2/1982
JP 59-016565 1/1984
JP 59-053871 4/1984
JP 59-106572 7/1984
JP 60-099359 7/1985
JP 61-098560 6/1986
JP 61-098561 6/1986
JP 61-163066 10/1986
JP 63-190670 8/1988

| | | |
|---|---|---|
| JP | 63-249566 | 10/1988 |
| JP | 01-079980 | 5/1989 |
| JP | 01-079981 | 5/1989 |
| JP | 01-122858 | 8/1989 |
| JP | 01-124258 | 8/1989 |
| JP | 01-215364 | 8/1989 |
| JP | 01-131639 | 9/1989 |
| JP | 01-167361 | 11/1989 |
| JP | 02-021959 | 1/1990 |
| JP | 02-152569 | 6/1990 |
| JP | 02-191565 | 7/1990 |
| JP | 3041961 | 2/1991 |
| JP | 3173565 | 7/1991 |
| JP | 04-062680 | 5/1992 |
| JP | 04-074560 | 6/1992 |
| JP | 4200468 | 7/1992 |
| JP | 08-000149 | 1/1996 |
| JP | 08-000150 | 1/1996 |
| JP | 10-337144 | 12/1998 |
| JP | 2000-316452 | 11/2000 |
| JP | 2001-029849 | 2/2001 |
| JP | 2001-029850 | 2/2001 |
| SU | 1437026 | 11/1988 |
| WO | WO 88/06404 | 9/1988 |
| WO | WO 90/11010 | 10/1990 |
| WO | WO 95/15146 | 6/1995 |
| WO | 9608317 A1 | 3/1996 |
| WO | WO 97/29790 | 8/1997 |
| WO | WO 00/32153 | 6/2000 |
| WO | WO 02/35948 | 5/2002 |

* cited by examiner

SELF-CONTAINED MULTI-SPRAYER

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates to a self-contained pressure sprayer, and more particularly to a rolling sprayer assembly that includes a wheel driven pumping mechanism and a fluid-driven motor for pumping a chemical concentrate and a diluting fluid.

2. Description of the Background of the Invention

Pressure sprayers with wheel-driven pumping mechanisms have been used to spray mixtures of fluids. In one type of wheel-driven sprayer, an axle that extends between two wheels includes a cam disposed thereon. Rotational movement of the axle imparts similar rotational movement to the cam. The rotational motion of the cam is utilized to operate a pressure pump attached thereto. The pressure pump pumps pressurized liquid from a storage tank into an accumulator tank. A relief valve is provided on the accumulator tank to relieve excessive buildup of pressure within the accumulator tank. The liquid is sprayed from the accumulator tank through the use of a spray wand.

In a different wheel driven sprayer, the sprayer includes two wheels connected by an axle. Rotational movement of the axle is translated into motion for actuating several pumps. The several pumps receive fluid from a tank and pump the pressurized fluid into a pressure tank. A discharge pipe is connected to the pressure tank by way of a two-way valve that allows the discharge of pressurized fluid from the sprayer through a nozzle pipe line or an agitating nozzle.

Pressurized sprayers with self-cleaning systems have also been used. In one example, a sprayer includes a chemical concentrate tank used to store a mixture of a first pressurized chemical concentrate. During a cleaning cycle a line not used in a spraying operation of the first chemical concentrate is used to inject pressurized water into the chemical concentrate tank. Thus, the chemical concentrate tank is purged of any residual amount of the first chemical concentrate so that the chemical concentrate tank can be used for a second, different chemical concentrate.

SUMMARY OF THE INVENTION

According to one embodiment of the present invention a pressure sprayer comprises an accumulator vessel adapted to hold a pressurized fluid therein and a connector adapted to connect with a container holding a chemical concentrate. A motor is in fluid communication with the accumulator vessel and the container when so connected. The motor is adapted to be driven by the pressurized fluid and to pump the pressurized fluid and the chemical concentrate. A chamber is adapted to receive the chemical concentrate and the pressurized fluid from the motor to form a chemical solution. A nozzle is in fluid communication with the chamber.

According to another embodiment of the present invention, a pressure sprayer comprises a housing having a first piston, a second piston, and a mixture controller disposed therein. The first piston is adapted to be driven by a first fluid under pressure. The second piston is adapted to pump a quantity of a second fluid. A mixture controller is also provided that operatively couples the first and second pistons to control the quantity of the second fluid pumped by the second piston.

In a different embodiment of the present invention, a pressure sprayer comprises a housing supported by at least one wheel. Further, a tank is provided for holding a fluid and an accumulator vessel for holding a pressurized fluid. A pump is provided for pressurizing and advancing the fluid from the tank to the accumulator vessel in response to movement of the at least one wheel. A container is configured to hold a chemical concentrate. A fluid motor is in fluid communication with the accumulator vessel and the container. The fluid motor is adapted to be driven by the pressurized fluid from the accumulator vessel and to pump the chemical concentrate from the container to a static mixer. The static mixer is adapted to mix the chemical concentrate with the pressurized fluid to form a chemical solution. A nozzle is also provided that is adapted to spray the chemical solution.

DETAILED DESCRIPTION

Mobile spraying assemblies such as the one described herein are utilized to hold and discharge fluids under pressure. Typically, the fluid discharged will be a mixture or solution having desirable characteristics for commercial or private applications. For example, a person could use a mobile spraying assembly to dispense a fertilizer or cleaning solution, or an herbicide, fungicide, insecticide, or other pesticide or surface treatment product onto the ground, a plant, or other surface. Indeed, any type of fluid with or without particles suspended therein may be dispensed from a mobile spraying assembly described herein.

Figure 1:
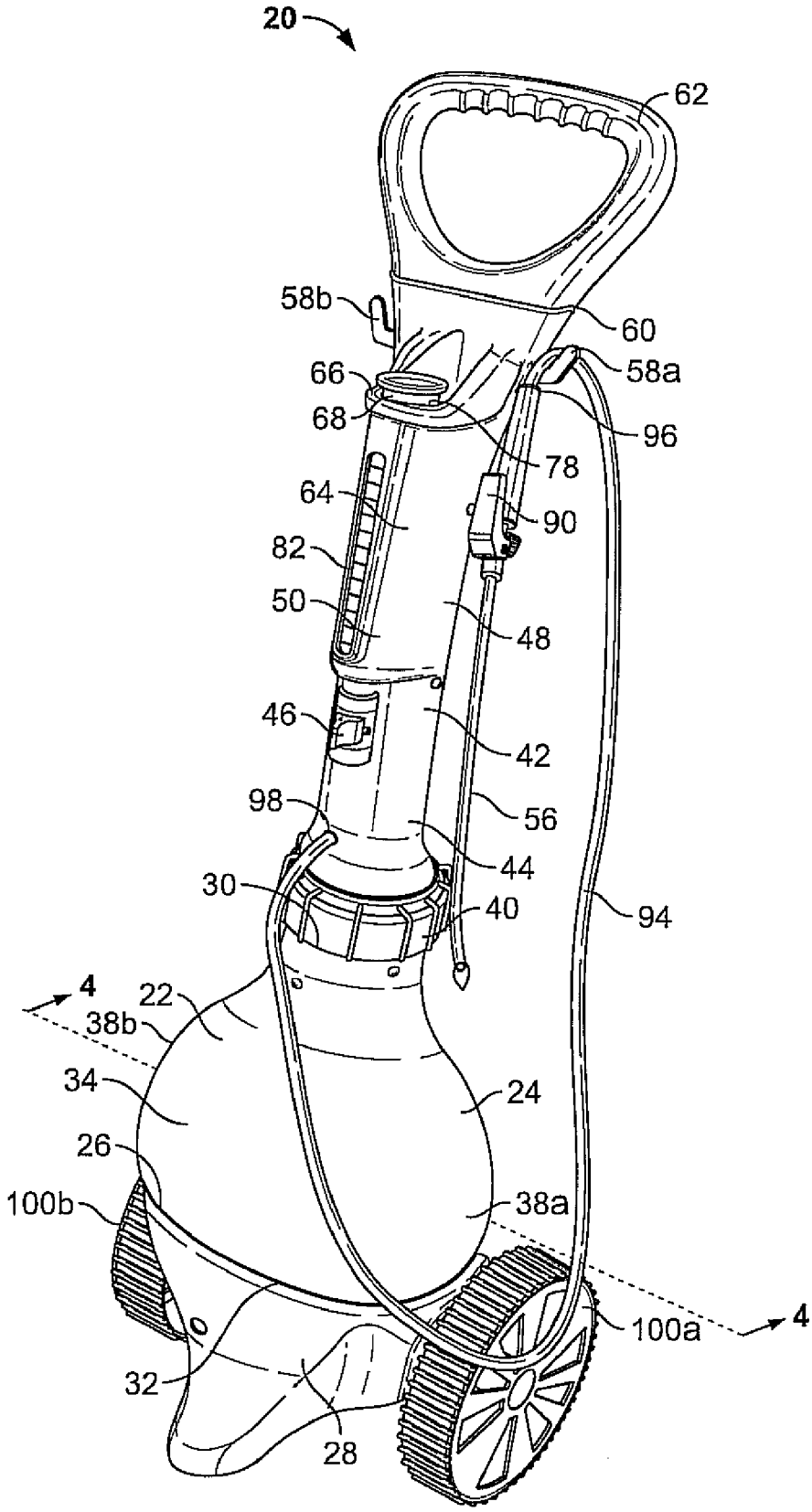
FIG. 1 is a front isometric view of a sprayer device.
Figure 2:
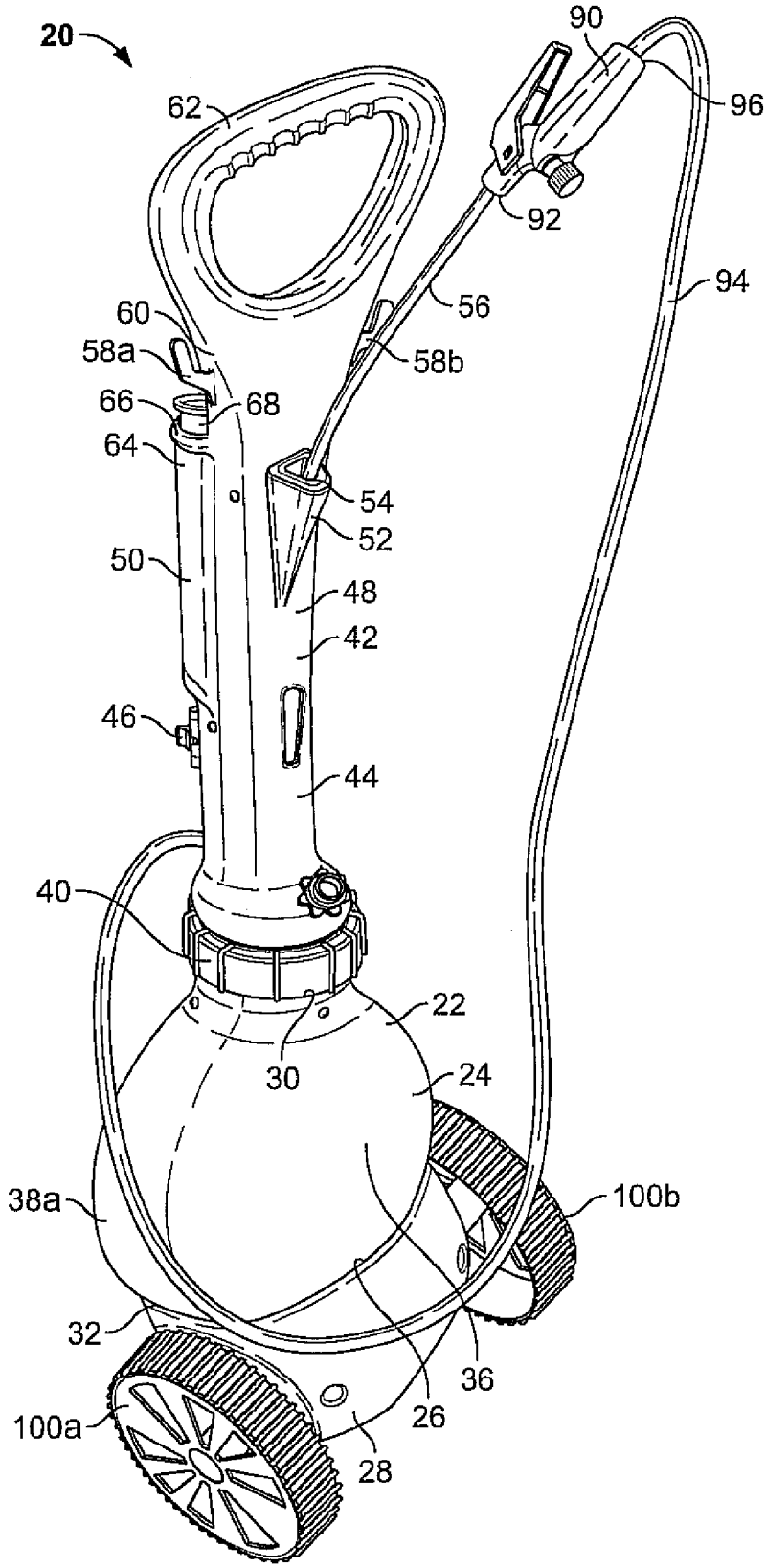
FIG. 2 is a rear isometric view of the sprayer device of FIG. 1.
Figure 2A:
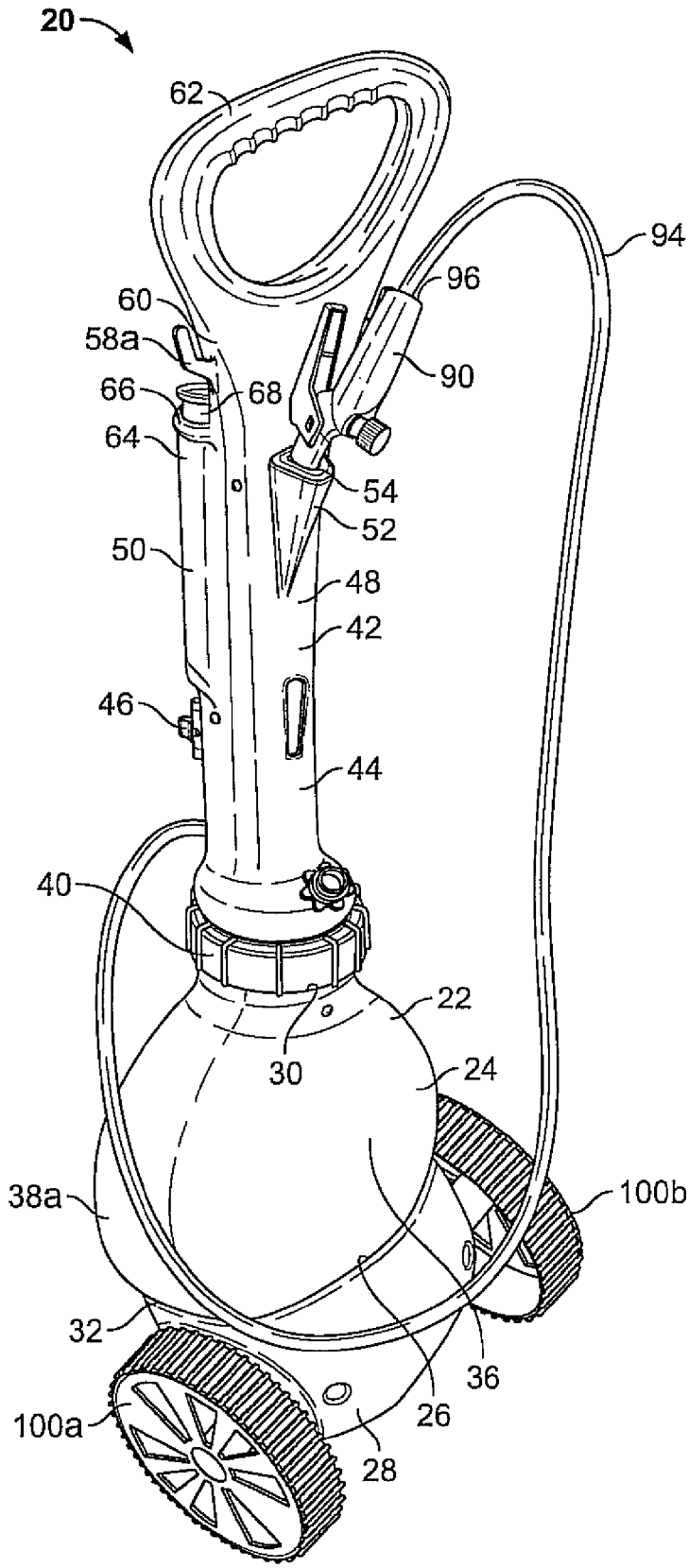
FIG. 2A is another rear isometric view of the sprayer device similar to FIG. 2.

FIGS. 1, 2, and 2A depict one embodiment of a mobile spraying assembly indicated as a spraying device 20. The spraying device 20 generally includes a body 22. The body 22 comprises a fluid tank 24 mounted on a top end 26 of a housing 28. The mechanisms for operating the spraying device 20, which will be described in detail hereinafter, are disposed within a hollow inner portion of the housing 28. The fluid tank 24 is generally curvilinear in shape with truncated flat top and bottom ends 30, 32, respectively. The fluid tank 24 is characterized by a bulbous portion adjacent the bottom end 32 that tapers inwardly toward the top end 30. The fluid tank 24 includes a curved front wall 34 and a curved rear wall 36 that taper into adjacent portions of side walls 38*a*, 38*b*. The fluid tank 24 may be removably mounted to the housing 28 or permanently mounted thereto. In the present embodiment, the entire area of the fluid tank 24 is transparent to provide a fluid level indicating system to a user. In other embodiments, opaque or partially transparent or translucent walls or areas may be provided.

A cover plate 40 is secured to the top end 30 of the fluid tank 24. In the present embodiment the cover plate 40 is removably secured to the fluid tank 24 by corresponding screw threads adjacent the top end 30 of the fluid tank 24 and an interior of the cover plate 40. An elongate structure 42 extends upwardly, for example, away from the fluid tank 24, from the cover plate 40. A lower portion 44 of the elongate structure 42 includes a switch 46. The switch 46 is toggled by a user to vary the rate at which a chemical concentrate, or other fluid, is dispensed from the spraying device 20 during an in use condition. A medial portion 48 of the elongate structure includes a container housing 50 that is integrally attached to, and protrudes from, the elongate structure 42. On an opposing side of the medial portion 48, a member 52 protrudes from the elongate structure 42. The member 52 includes a recess 54 for receipt of a spraying wand 56 or other spraying means. Two hooks 58*a*, 58*b*, are disposed on the elongate structure 42 adjacent a distal portion 60 thereof. Further, a handle 62 is disposed on the distal portion 60 of the elongate structure 42 that is adapted to be gripped by a user's hand. In one embodiment, the elongate structure 42 is adjustable so that varying heights may be imparted to the handle 52 based upon the height of the user.

Figure 3:
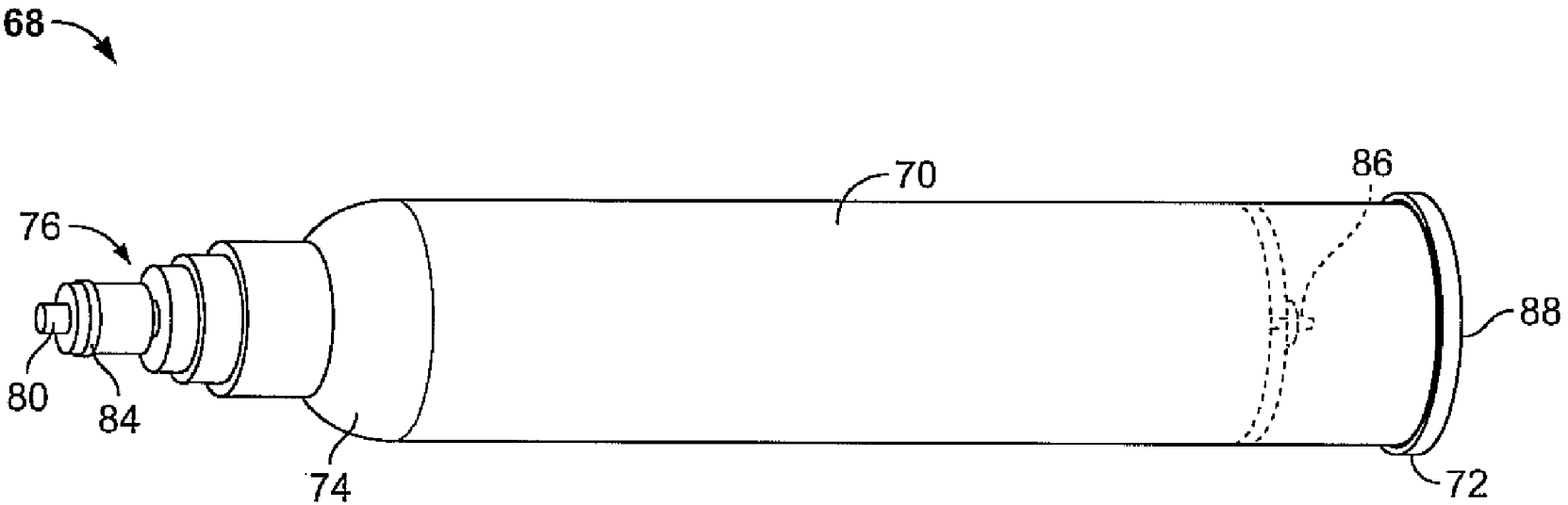
FIG. 3 is an isometric view of a container depicted in FIG. 1.

The container housing 50 is generally cylindrical in shape and includes a sidewall 64 and a top end 66 adjacent the distal portion 60 of the elongate structure 42. The container housing 50 includes an axial length that extends in a similar direction as an axial length of the elongate structure 42. The container housing 50 is adapted to receive a container 68 such as the one shown in FIG. 3. The container 68 includes a cylindrical body section 70 with a bottom end 72 and a top end 74. The top end 74 includes a valve mechanism 76 that is capable of opening and closing to dispense fluid from the container 68. The container 68 is inserted into the container housing 50 by, for example, sliding the top end 74 of the container 68 through a recess 78 in the top end 66 of the container housing 50. Upon disposing the container 68 into the container housing 50, a tip 80 of the valve mechanism 76 is inserted into a receiving socket (not shown) within an interior of the container housing 50. In the present embodiment interior surfaces of the sidewall 64 are sized to cooperatively interact with the body 70 of the container 68 to guide same into the container housing 50 and the tip 80 of the valve mechanism 76 into the receiving socket. In one embodiment a rib (not shown) is disposed on the body 70 of the container 68 to engage with a detent (not shown) on the interior of the sidewall 64 to assist in releasably retaining the container 68 within the container housing 50. The sidewall 64 is also provided with an aperture 82 to provide the user an indication of the level of fluid remaining within the container 68. Upon insertion of the tip 80 into the receiving socket, the valve mechanism 76 is opened to allow fluid from within the container 68 to be drawn into the sprayer device 20. An O-ring seal 84 surrounding the tip 80 prevents fluid from within the container 68 from leaking. A relief valve 86 is disposed in an interior of the container 68 adjacent the bottom end 72 thereof to relieve the negative pressure that would otherwise occur as the fluid in the container 68 is drawn into the sprayer device 20. A protective cap 88 is disposed over the bottom end 72 in a non-air tight manner for aesthetic purposes and for protecting the relief valve 86 from becoming clogged with debris or the like. Couplings and valves suitable for use in this arrangement are available from the Colder Products Company of St. Paul, Minn.

With reference again to FIG. 1, the spraying wand 56 is connected to a hand-held trigger device 90 at a first end thereof 92. The trigger device 90 is manipulated by a user to commence or stop a spraying operation of the spraying device 20 in a manner known to those skilled in the art. The trigger device 90 is also connected to a hose 94 at a second end 96 thereof. The hose 94 is preferably flexible and extends to and through an orifice 98 in the lower portion 44 of the elongate structure 42. The spraying wand 56 may be wrapped around one or more of the hooks 58*a*, 58*b* during a non-use condition as depicted in FIG. 1. Alternatively, the spraying wand 56 may be inserted into the recess 54 of the member 52 on the elongate structure 42. FIG. 2 depicts the spraying wand 56 being inserted into the recess 54 and FIG. 2A depicts the spraying wand 56 resting completely within the recess 54.

Figure 4:
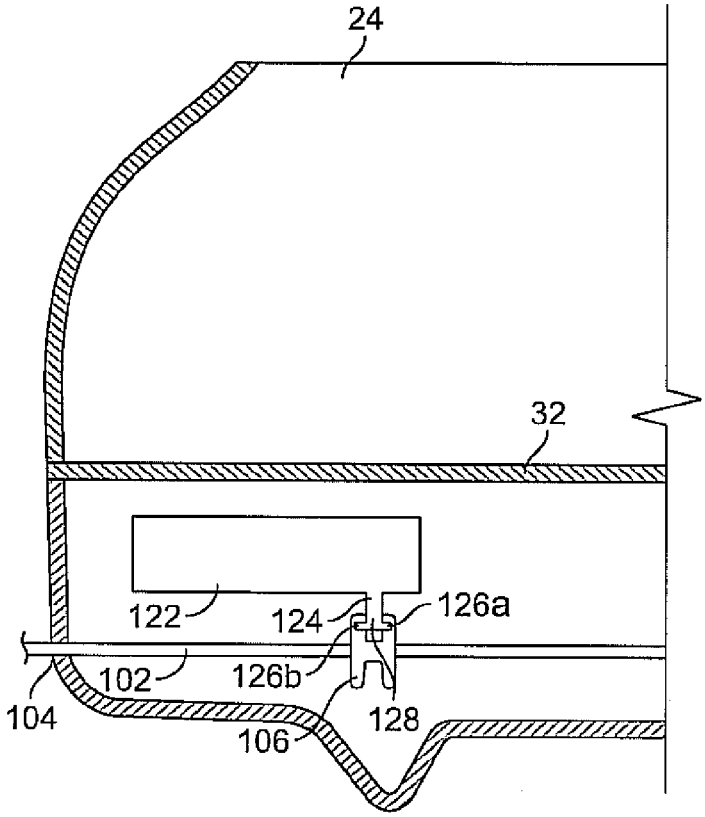
FIG. 4 is an enlarged, partial sectional view taken along the lines 4-4 of FIG. 1 showing an interior of the housing and omitting portions behind the plane of section for purposes of clarity.
Figure 5:
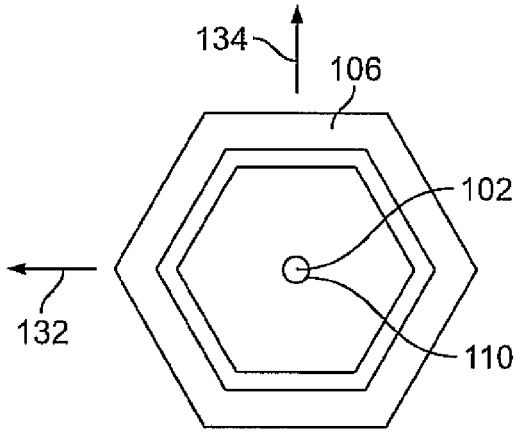
FIG. 5 is an enlarged front elevational view of the gear depicted in FIG. 4.
Figure 5A:
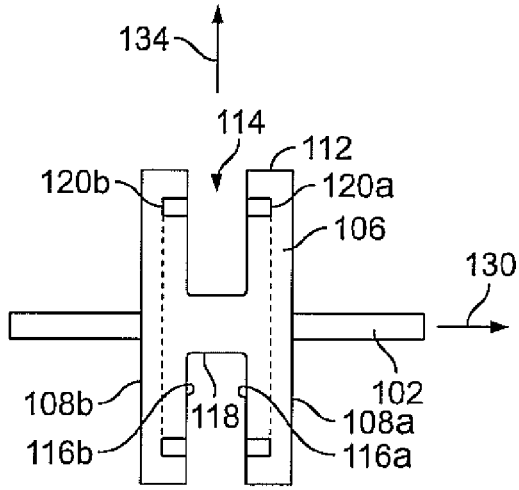
FIG. 5A is a side elevational view of the gear of FIG. 5.

With respect to FIGS. 1 2, and 2A, wheels 100*a*, 100*b* are rotatably mounted adjacent side walls of the housing 28. FIG. 4 depicts a partial view of the spraying device 20 of FIGS. 1, 2, and 2A and an axle 102 that the wheels 100*a*, 100*b* are mounted to. FIG. 4 also shows that the axle 102 extends through a hole 104 in the housing 28. When the spraying device 20 is in an operational state, the wheels 100*a*, 100*b* are rigidly mounted to the axle 102 on an exterior side of the housing 28. The wheels 100*a*, 100*b* facilitate movement of the spraying device 20 over a surface. Further, movement of the spraying device 20 via the wheels 100*a*, 100*b* causes a pump gear 106 (such as the one depicted in FIGS. 4, 5 and 5A) that is fixedly attached to the axle 102 to rotate therewith.

The pump gear 106 is fixedly attached to a portion of the axle 102 within the interior of the housing 28. FIG. 4 depicts one example of the pump gear 106 positioned on the axle 102. The pump gear 106 is generally hexagonal in shape and includes two opposing outer sides 108*a*, 108*b*. A hole 110 extends through a center of the pump gear 106 between the outer sides 108*a*, 108*b*. The axle 102 is fixedly attached to portions of the pump gear 106 that define the hole 110. The pump gear 106 further includes a sidewall 112 that extends between the opposing outer sides 108*a*, 108*b*. A recess 114 extends circumferentially about the pump gear 106 within the sidewall 112. The recess 114 is defined by opposing inner sides 116*a*, 116*b* and a bottom side 118. Each of the inner sides 116*a*, 116*b* includes a hexagonal groove 120*a*, 120*b*, respectively, that extends circumferentially about the pump gear 106 in a similar manner as the sidewall 112.

The pump gear 106 is adapted to functionally interrelate with a pump 122 disposed within the housing 28, that is, the pump gear 106 drives the pump 122 to pressurize a fluid, such as water or a solution containing a surfactant or other material intended to improve the performance of the chemical concentrate to be dispensed by the sprayer. The pump 122 may be any type of positive displacement pump. However, it is envisioned that any other pump known to those skilled in the art may also be used with the present embodiments. The pump 122 includes an arm 124 with opposing fingers 126*a*, 126*b* on a distal end 128 thereof. The fingers 126*a*, 126*b* are sized to fit within the hexagonal grooves 120*a*, 120*b*, respectively. During operation of the spraying device 20 a user pushes the device 20 over a surface by imparting rotational motion to the wheels 100*a*, 100*b*. The rotational movement of the wheels 100*a*, 100*b* is translated into rotational movement of the axle 102 and the pump gear 106. When the pump gear 106 is rotated the fingers 126*a*, 126*b* are forced to follow the path defined by the hexagonal grooves 120*a*, 120*b*. However, unlike the axle 102 that is not displaced about an X axis 130, a Y axis 132, or a Z axis 134 with respect to a center of the pump gear 106 during rotation thereof, the hexagonal grooves 120*a*, 120*b* are displaced about the Z axis 134 during rotation of the pump gear 106. Therefore, as the pump gear 106 is rotated about the axle 102, the rotational movement of the pump gear 106 is translated into linear motion of the fingers 126*a*, 126*b* within the hexagonal grooves 120*a*, 120*b*. The hexagonal grooves 120*a*, 120*b* cause the fingers 126*a*, 126*b* to be alternatively raised and lowered about the Z axis 134. The linear motion of the fingers 126*a*, 126*b* is similarly translated through the arm 124 and to the pump 122. The alternating motion of the arm 124 about the Z axis 134 imparts alternating pressure differentials between two chambers (not shown) of the pump 122.

In a different embodiment the pump gear 106 is provided with a differing shape but still includes the hexagonal grooves 120*a*, 120*b*. In yet another embodiment, the grooves 120*a*, 120*b* are imparted with another geometric shape such as an octagon or a triangle that similarly will allow for the rotational movement of the pump gear 106 to be translated into linear motion of the arm 124. In still another embodiment, a cam may be disposed on the axle 102 in contact with an appendage that depends from the pump 122 to translate rotational movement of the pump gear 106 into linear motion. Further, the pump gear 106 may be positioned anywhere along the axle 102 insofar as the functional relationship between the pump gear 106 and the pump 122 is maintained.

Figure 6:
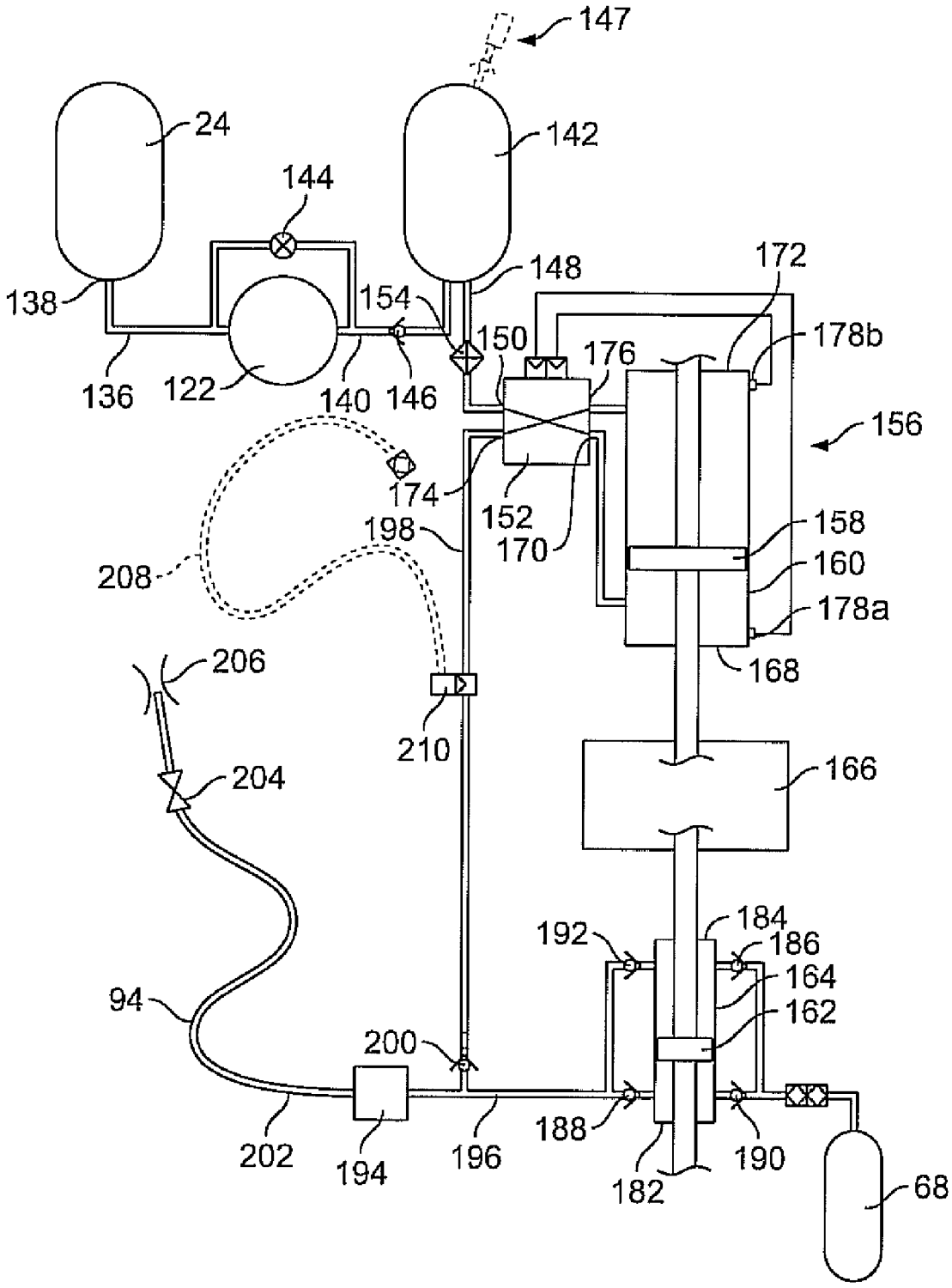
FIG. 6 is a schematic representation of a wheel driven fluid pressurization system and a motor.

Referring to FIG. 6, a fluid line 136 extends from the pump 122 to an outlet 138 of the fluid tank 24. The outlet 138 comprises an orifice disposed in the bottom end 32 of the fluid tank 24. The pressure differentials within the pump 122 that are a result of the movement of the spray device 20 force non-pressurized fluid from within the fluid tank 24 into the pump 122. Fluid from the pump 122 is discharged in a pressurized state through a second fluid line 140. The second fluid line 140 extends to an accumulator vessel 142, which acts as a repository for pressurized fluid. Continued motion of the spraying device 20 and the attendant rotational motion of the pump gear 106 will continue to force non-pressurized fluid from the fluid tank 24 through the pump 122 and into the accumulator vessel 142 in a pressurized state. In this manner, a user may easily pressurize a fluid and store same for future use. A relief valve 144 is also provided between the pump 122 and the accumulator vessel 142 to prevent over pressurization of same. Excess pressurized fluid is shunted through the relief valve 144 and back to the fluid line 136. The pressurized fluid in the accumulator vessel 142 is prevented from flowing back toward the pump 122 by way of an accumulator check valve 146.

In other embodiments, the accumulator vessel 142 may be pressurized in ways other than a wheel driven pump such as the pump 122 shown herein. For example, the accumulator vessel 142 may be adapted to be pressurized by a pressurized air and/or water system such as a garden hose pressurized from a municipal water supply. Illustratively, a user attaches the garden hose (not shown) to an adaptor 147 that comprises a connector and a one way check valve to fill the accumulator vessel 142 with the pressurized water to pressurize the accumulator vessel 142. In another embodiment, an amount of water is added to an opening in the accumulator vessel and is then seated by, for example, securely closing a cap or lid disposed on the accumulator vessel to provide an air-tight seal. In this embodiment, the accumulator vessel 142 is then pressurized through the adaptor 147 by a pressurized air or gas source such as from, for example, a remote air compressor, an air pump such as a foot or hand pump, or a compressed $CO_2$ cylinder connected with the accumulator vessel. A pressure gauge or other pressure indicator (not shown) may be provided in any of the embodiments described herein to indicate that sufficient pressure is present in the accumulator vessel 142 to drive the various components of the spraying device 20.

The pressurized fluid in the accumulator vessel 142 is flowable through a third fluid line 148 (FIG. 6). The third fluid line 148 extends between the accumulator vessel 142 and an inlet 150 of a valve 152. An accumulator filter 154 is provided between the accumulator vessel 142 and the valve 152 to filter incidental debris, rust or lime particles, or other particles that could interfere with operation of the sprayer.

The valve 152 is preferably a four-way valve similar to the one depicted in FIG. 6. The valve 152 is in fluid communication with a motor 156, which comprises two operationally connected pistons. A first piston is generally referred to as a power piston 158 and is disposed within a power cylinder 160. A second piston is generally referred to as a pumping piston 162 and is disposed within a pumping cylinder 164. A mixture controller 166, which will be described in detail hereinafter, operationally connects both the power piston 158 and the pumping piston 162.

Referring again to FIG. 6, the operation of the valve 152 and the motor 156 will be described in more particularity. When the spraying device 20 is in an operational spraying mode, the valve 152 is opened to provide the pressurized fluid to the power piston 158 and the power cylinder 160. The valve 152 is adapted to initiate one of two operational sequences dependent on the initial position of the power piston 158 within the power cylinder 160. In a first configuration, the power piston 158 is disposed adjacent a first end 168 of the power cylinder 160. When the power piston 158 is in the first configuration, a first operational sequence provides for the release of the pressurized fluid from a first opening 170 of the valve 152. Release of the pressurized fluid from the first opening 170 causes the pressurized fluid to enter the power cylinder 160 adjacent the first end 168 thereof. The pressurized fluid thereafter forces the power piston 158 toward a second end 172 of the power cylinder 160. Movement of the power piston 158 toward the second end 172 forces pressurized fluid in the power cylinder 160 adjacent the second end 172 to be ejected through an outlet 174 of the valve 152. Thereafter, fluid is released through a second opening 176 of the valve 152. Release of the pressurized fluid from the second opening 176 causes the pressurized fluid to enter the power cylinder 160 adjacent the second end 172 thereof. The pressurized fluid thereafter forces the power piston 158 toward the first end 168 of the power cylinder 160 and ejects fluid adjacent the first end through the outlet 174 of the valve 152. These steps are repeated by alternating the release of the pressurized fluid between the first and second openings 170, 176 of the valve 152 dependent on the position of the power piston 158. Similarly, a second configuration is provided for when the power piston 158 is disposed adjacent the second end 172 of the power cylinder 160. When the power piston 158 is in the second configuration, a second operational sequence provides for the release of the pressurized fluid from the second opening 176 of the valve 152 first and thereafter alternates between the first and second openings 170, 176 of the valve 152 as indicated above.

The timing for switching between the release of the pressurized fluid from the first and second openings 170, 176 coincides with the position of the power piston 158 within the power cylinder 160. The control of the timing is accomplished by providing a pair of limit switches 178*a*, 178*b* as shown in FIG. 6. Illustratively, when the power piston 158 moves toward the first end 168 of the power cylinder 160, the limit switch 178*a* is triggered after the power piston 158 finishes a complete stroke, for example, the power piston 158 is at the proscribed limit for movement in a certain direction whether the proscribed limit is dependent on user defined parameters or physical limitations. Upon triggering the limit switch 178*a*, the valve 152 responds by releasing the pressurized fluid through the first opening 170 adjacent the first end 168 of the power cylinder 160. Thereafter, the power piston 158 moves toward the second end 172 of the power cylinder 160 and continues such movement until the limit switch 178*b* is triggered, wherein the valve 152 stops the release of the pressurized fluid from he first opening 170 and begins the release of the pressurized fluid from the second opening 176. The release of the pressurized fluid from the first and second openings 170, 176 continues to alternate based upon the activation of the limit switches 178*a*, 178*b*. The valve 152 and the power cylinder 160 arrangement discussed above may be similar to, for example, the FV-5D four-way stem valve and the SDR-40-0.5" cylinder, respectively, manufactured by Clippard Instrument Laboratory, Inc.

Figure 7:
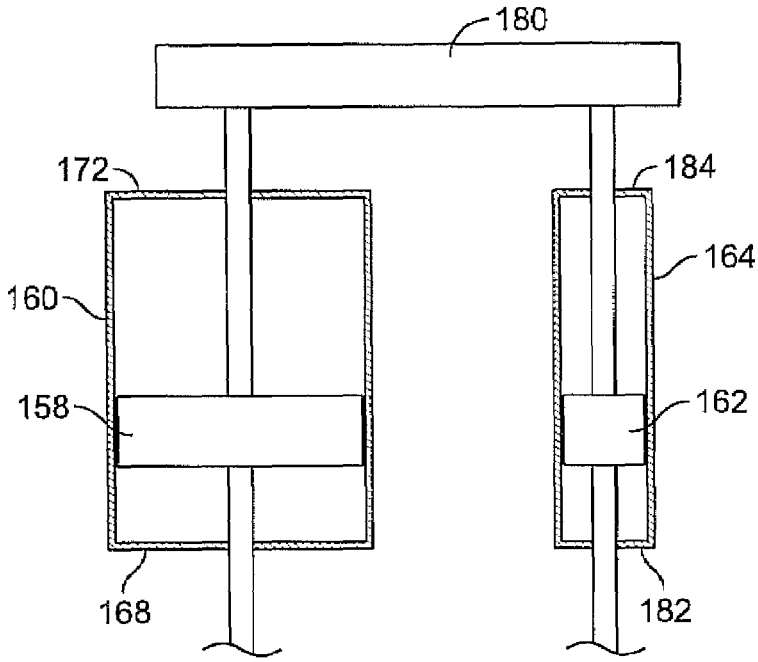
FIG. 7 is a schematic view of a first embodiment of a mixture controller.

As noted above, the power piston 158 is operatively attached to the pumping piston 162 by the mixture controller 166. In one embodiment, the mixture controller 166 comprises a fixed linkage. FIG. 7 depicts one such fixed linkage in the form of a connecting member 180. During an operational sequence, as the power piston 158 moves toward the first end 168 of the power cylinder 160, the pumping piston 162 similarly moves a predetermined distance toward a corresponding first end 182 of the pumping cylinder 164. Likewise, as the power piston 158 moves toward the second end 172 of the power cylinder 160 the pumping piston 162 moves toward a second end 184 of the pumping cylinder 164. As the power piston 158 is reciprocally driven by the pressurized fluid from the accumulator vessel 142, the connecting member 180 concurrently drives the pumping piston 162. A pumping cylinder similar to the one described herein is manufactured by, for example, Clippard Instrument Laboratory, Inc., under the product name "SDR-05-0.5."

Similar to the power piston 158 discussed above, reciprocal motion of the pumping piston 162 alternatively increases and decreases the volume on opposing sides of the pumping piston 162 within the pumping cylinder 164. As the pumping piston 162 moves toward the first end 182, the volume expansion within the pumping cylinder 164 adjacent the second end 184 thereof draws a predetermined amount of the fluid from within the container 68 through a first inlet check valve 186 and into a portion of the pumping cylinder 164 adjacent the second end 184. Concurrently, the volume contraction on the opposing side of the pumping cylinder 164 adjacent the first end 182 causes the expulsion of a predetermined amount of the fluid through a first outlet check valve 188. Similarly, when the pumping piston 162 is directed toward the second end 184 of the pumping cylinder 164, fluid from the container 68 is drawn into the pumping cylinder 164 adjacent the first end 182 through a second inlet check valve 190. The volume contraction on the opposing side causes the fluid disposed within the pumping cylinder 164 adjacent the second end 184 thereof to be dispensed through a second outlet check valve 192. Inlet and outlet check valves similar to the first and second inlet check valves 186, 190 and the first and second outlet check valves 188, 192 are manufactured and sold under the product names of, for example, MCV-1AB and MCV-1, respectively, by Clippard Instrument Laboratory, Inc. Thus, by operation of the motor 156 as described, a consistently measured quantity of chemical concentrate is pumped in correlation to a consistent quantity of fluid from the accumulator vessel 142.

Referring now to FIG. 6, it may be seen that the contents of the container 68 dispensed through the pumping piston 162 and the first and second outlet check valves 188, 192 are pumped toward a mixing chamber 194 through a fourth fluid line 196. Similarly, the pressurized fluid ejected through the outlet 174 of the valve 152 is pumped to the mixing chamber 194 through a filth fluid line 198. A check valve 200 is provided on the fifth fluid line 198 between the outlet 174 and the mixing chamber 194 to prevent backflow of the pressurized fluid to the valve 152. In one embodiment, the pressurized fluid dispensed from the power piston 158 is water and the fluid dispensed from the pumping piston 162 is a chemical concentrate. The water and chemical concentrate are received and mixed together within the mixing chamber 194 to form a solution or mixture. The mixing chamber 194 may be a chamber or passage with baffles or other structures to encourage mixing or, optionally, may simply be a fluid line that receives and allows to mix therewithin fluid from both the fourth and fifth fluid lines 196,198. The hose 94 connected to the second end 96 of the trigger device 90 is also attached to an outlet 202 of the mixing chamber 194. A hose valve 204 and a nozzle 206 are disposed within the trigger device 90 and the spraying wand 56, respectively. When a user desires to operate the spraying device 29 the hose valve 204 is opened by actuating the trigger device 90 to dispense fluid therethrough and past the nozzle 206. The nozzle 206 may have varying characteristics known to those skilled in the art to provide for projected streams of the dispensed fluid or certain other characteristics such as the atomization of the fluid.

The present spraying device 20 may also include a cleaning hose 208. One end of the cleaning hose 208 is connected to the fifth fluid line 198 via a cleaning hose valve 210. The cleaning hose valve 210 is preferably disposed between the outlet 174 and the check valve 200. The other end of the cleaning hose 208 is connectable to the receiving socket within the container housing 50 in a similar manner as the container 68. When the cleaning hose valve 210 is opened the pressurized water from the accumulator vessel 142 flushes out any residual chemical concentrate within the spraying device 20.

The connecting member 180 of the present embodiment allows a predetermined and/or adjustable amount of fluid to be drawn from the container 68 by the pumping piston 162 and mixed with a predetermined amount of pressurized fluid drawn from the accumulator vessel 142 by the power piston 158. To change the ratio of fluids mixed within the mixing chamber 194, the width of one or more of the power piston 158 and the pumping piston 162 may be altered to increase or decrease the corresponding amount of fluid drawn from the accumulator vessel 142 and the container 68. Further, the stroke lengths of the power piston 158 and the pumping piston 162 could be changed or the timing for the limits switches 178*a*, 178*b* altered.

Figure 8:
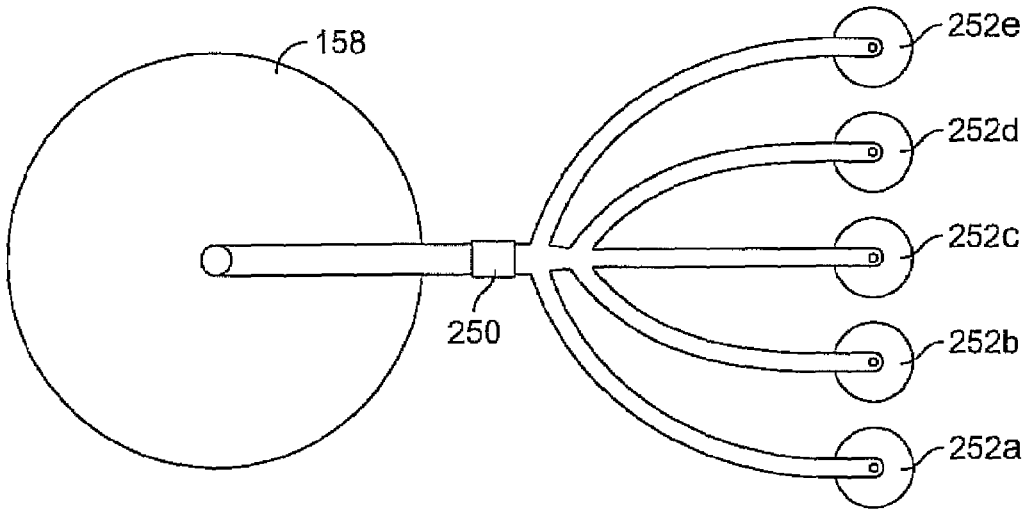
FIG. 8 is a schematic view of a second embodiment of a mixture controller.

FIG. 8 depicts another embodiment of a connecting member 250 that may be used with the spraying device 20. In the present embodiment the power piston 158 is operatively coupled to a plurality of pumping pistons 252*a*, 252*b*, 252*c*, 252*d*, 252*e* with varying or similar width dimensions. A user may choose which pumping piston 252*a*, 252*b*, 252*c*, 252*d*, 252*e* to link with the power piston 158. Alternatively, two or more of the plurality of pumping pistons 252*a*, 252*b*, 252*c*, 252*d*, 252*e* may be operatively linked with the power piston 158 at the same time. In this embodiment, the plurality of pumping pistons 252*a*, 252*b*, 252*c*, 252*d*, 252*e* could also have identical or differing width and/or volume dimensions. Further, the exact shape of the connecting member 250 in the present embodiment and the other embodiments herein is not limiting. Rather, the connecting member 250 need only impart to the pumping pistons 252*a*, 252*b*, 252*c*, 252*d*, 252*e* the functional characteristics discussed herein. As noted in connection with other embodiments, the ability to select one or more pumping pistons allows the amount of fluid drawn from the container 68 by the pumping piston(s) to be variably controlled and/or application specific.

Figure 9:
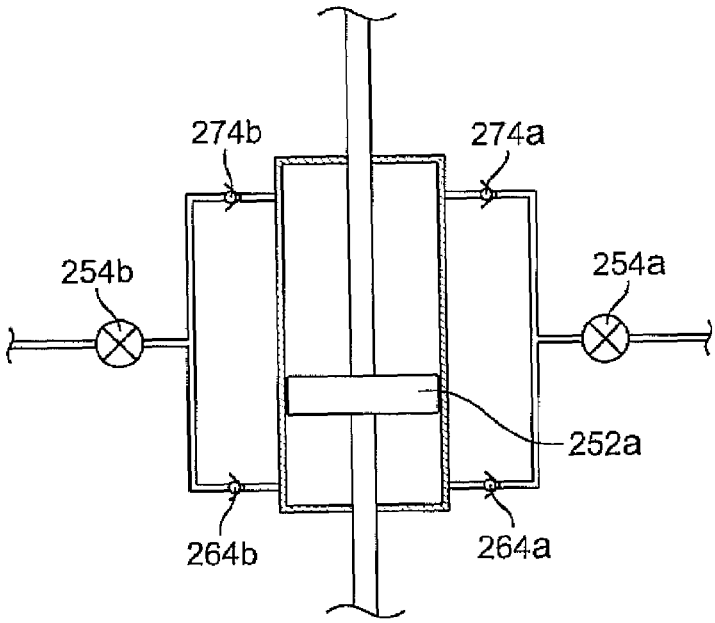
FIG. 9 is a schematic view of a mixture controller similar to FIG. 3 with only one pumping piston shown.
Figure 10:
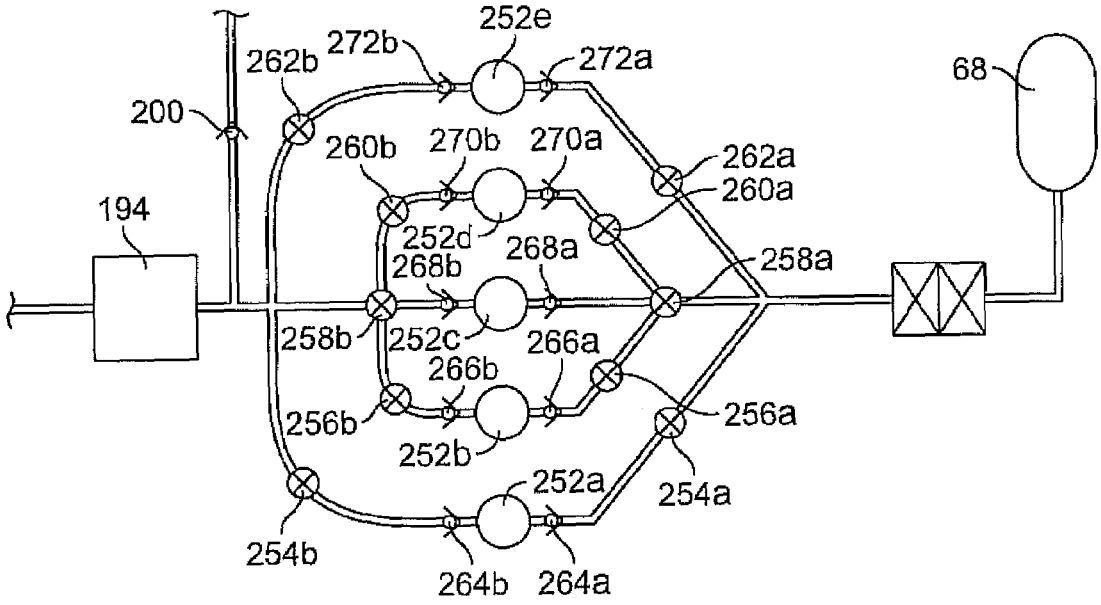
FIG. 10 is a schematic view of a mixture controller similar to FIG. 8 with several pumping pistons shown.

FIGS. 9 and 10 provide one example of how the plurality of pumping pistons 252*a*, 252*b*, 252*c*, 252*d*, 252*e* may be operated to work individually or in conjunction with one another. Each of the plurality of pumping pistons 252*a*, 252*b*, 252*c*, 252*d*, 252*e* includes a pair of vent valves 254*a* and 254*b*, 256*a* and 256*b*, 258*a* and 258*b*, 260*a* and 260*b*, and 262*a* and 262*b*, respectively, on opposing sides thereof, for example, on an upstream side and a downstream side of the respective pumping piston. Further, each of the pumping pistons 252*a*, 252*b*, 252*c*, 252*d*, and 252*e* includes a first pair of inlet and outlet check valves 264*a* and 264*b*, 266*a* and 266*b*, 268*a* and 268*b*, 270*a* and 270*b*, and 272*a* and 272*b*, respectively, on opposing sides thereof, and a second pair of inlet and outlet check valves similarly disposed on opposing sides of the pumping pistons 252*a*, 252*b*, 252*c*, 252*d*, and 252*e* (not shown for purposes of clarity). To select a particular pumping piston for operation the corresponding vent valves are placed in an active position. For example, FIG. 9 depicts the pumping piston 252*a* with the vent valves 254*a* and 254*b*. Placing the vent valve 254*a* in an active position allows for the chemical concentrate to pass therethrough and to the first inlet check valve 264*a* and a second inlet check valve 274*a* for the pumping piston 252*a*. Further, placing the vent valve 254*b* in an active position allows the chemical concentrate pumped from the pumping piston 252*a* to pass through the first outlet check valve 264*b* and a second outlet check valve 274*b* and through the vent valve 254*b*. Conversely, placing the vents 254*a* and 254*b* in an inactive position entails adjusting the vents 154*a* and 154*b* to be disposed in a venting position so that only air is pumped through the pumping piston 152*a*.

Figure 11:
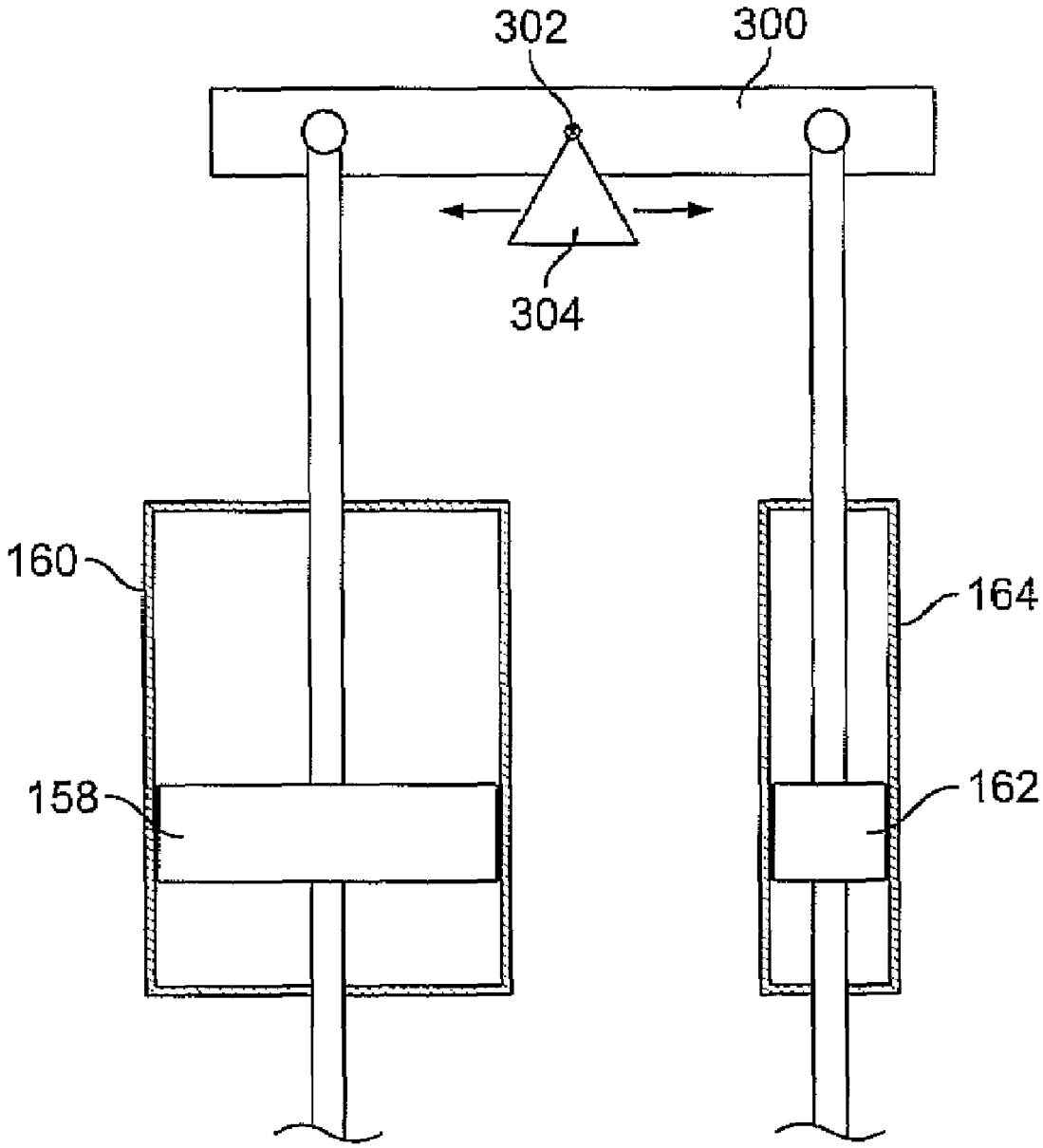
FIG. 11 is a schematic view of a third embodiment of a mixture controller.

FIG. 11 depicts yet another embodiment of a connecting member that comprises a pivoting linkage 300 that operatively connects the power piston 158 to the pumping piston 162. The pivoting linkage 300 includes a pivotal attachment point 302 that is connected to a movable fulcrum 304. The stroke length of the power piston 158 is fixed. Movement of the attachment point 302 of the movable fulcrum 304 toward the power piston 158 increases the stroke length of the pumping piston 162. Movement of the attachment point 302 of the movable fulcrum 304 away from the power piston 158 decreases the stroke length of the pumping piston 162. Changing the stroke length of the pumping piston 162 allows a user to variably control the amount of fluid drawn into the pumping piston 162.

Figure 12:
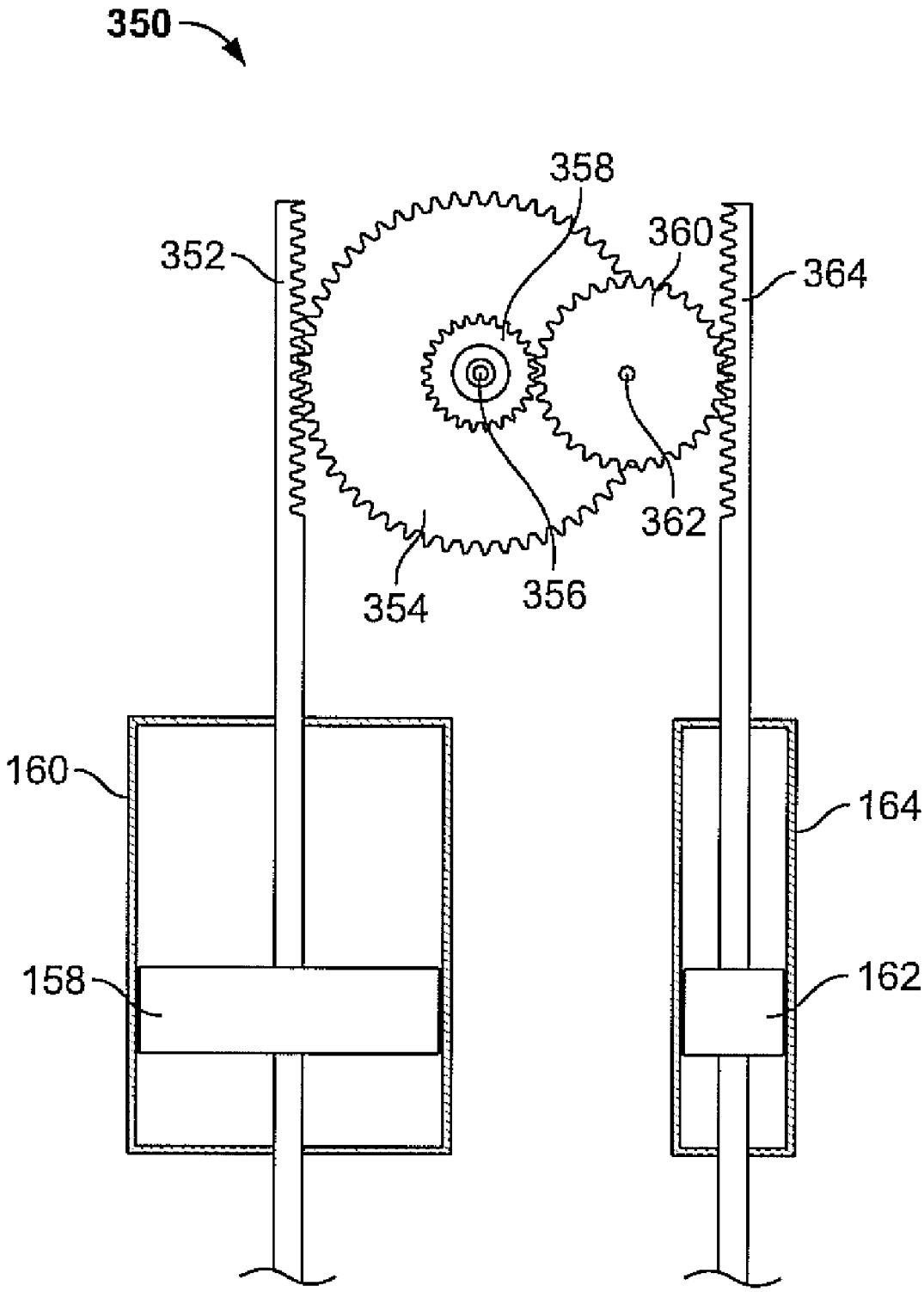
FIG. 12 is a schematic view of a fourth embodiment of a mixture controller.

In still another embodiment of a connecting member, which is depicted in FIG. 12 the operative connection between the power piston 158 and the pumping piston 162 is a rack and pinion gear system that has a gear transmission 350. A first rack gear 352 is attached to the power piston 158 for engagement with a primary gear 354. The primary gear 354 is mounted on a gear shaft 356. A first transmission gear 358 is similarly mounted to the gear shaft 356. The first transmission gear 358 engages a corresponding second transmission gear 360 mounted to a gear shaft 362. The second transmission gear 360 engages a second rack gear 364 attached to the pumping piston 162. A plurality of gears may be provided in conjunction with the first transmission gear 358 so that a user may adjust the amount of fluid drawn by the pumping piston 162.

Figure 13:
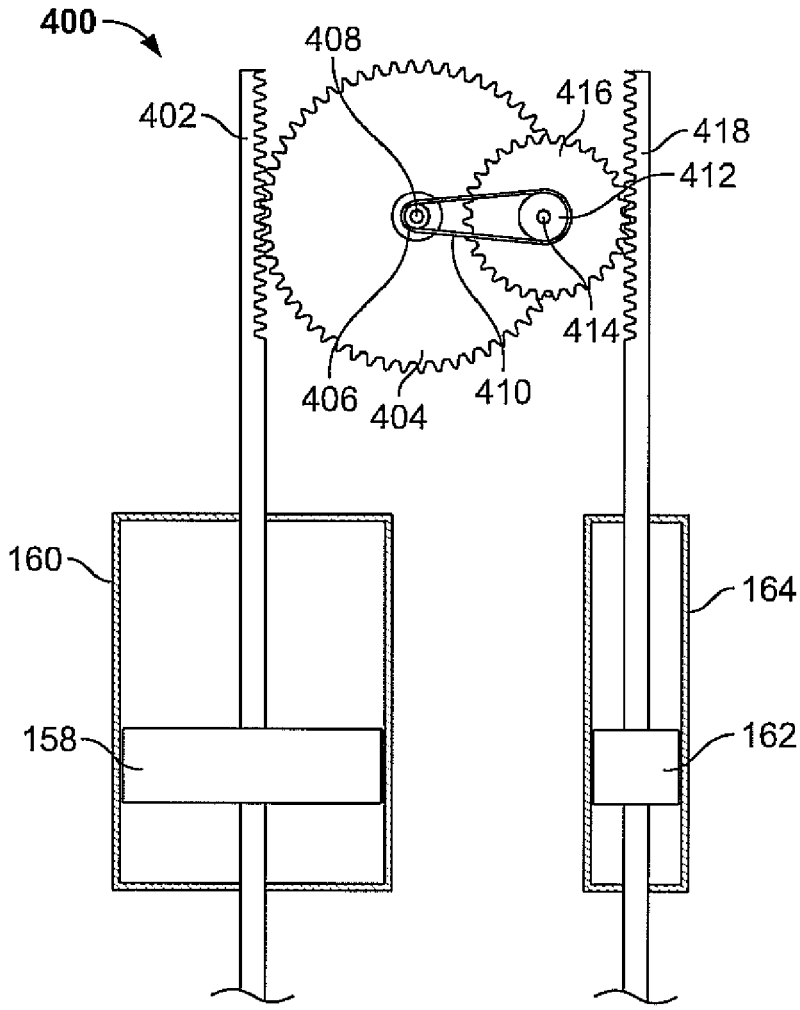
FIGS. 13 and 13A are schematic views of a fifth embodiment of a mixture controller.
Figure 13A:
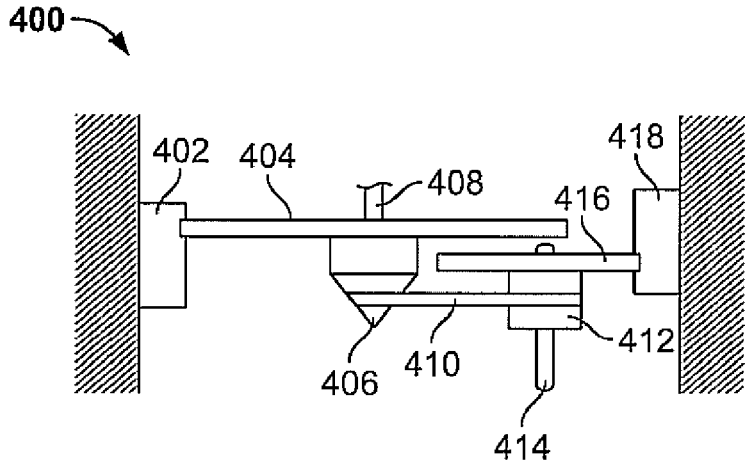

FIGS. 13 and 13A depict another embodiment of a connecting member similar to the one shown in connection with FIG. 12. However, the power piston 158 of the present embodiment is operatively connected to the pumping piston 162 by a rack and pinion gear system that has a cone and belt transmission 400. A first rack gear 402 is attached to the power piston 158 for engagement with a primary gear 404. The primary gear 404 and a cone 406 are mounted on a primary gear shaft 408. A belt 410 operatively connects the cone 406 with a spool 412 mounted on a transmission gear shaft 414. A second gear 416 is also mounted to the transmission gear shaft 414. The second gear 416 engages a second rack gear 418 attached to the pumping piston 162. A user may variably select the position of the belt 412 on the cone 406 to adjust the level of chemical concentrate drawn by the pumping piston 162.

INDUSTRIAL APPLICABILITY

The mobile spraying assemblies described herein provides a fluid driven motor for spraying a predetermined and/or adjustable mixture of two or more fluids, such as water and a chemical concentrate. The pressure sprayer may be used to mix and spray any combination of fluids and/or concentrates.

Numerous modifications to the present disclosure will be apparent to those skilled in the art in view of the foregoing description. Accordingly, this description is to be construed as illustrative only and is presented for the purpose of enabling those skilled in the art to make and use the pressurized sprayer of the disclosure and to teach the best mode of carrying out same.

The invention claimed is:

1. A pressure sprayer, comprising:

an accumulator vessel adapted to hold a pressurized fluid therein;

a connector adapted to connect with a container holding a chemical concentrate;

a motor in fluid communication with the accumulator vessel and the container when so connected, the motor comprising a first piston that is mechanically linked to a second piston, wherein the motor is adapted to be driven by the pressurized fluid and to continuously pump the pressurized fluid and the chemical concentrate;

a chamber adapted to receive and combine the chemical concentrate and the pressurized fluid from the motor to form a chemical solution; and a nozzle in fluid communication with the chamber, wherein the first piston is driven by the pressurized fluid from the accumulator vessel, the first piston concurrently drives the second piston, and the second piston, when so driven, pumps the chemical concentrate from a connected container.

2. The pressure sprayer of claim 1, wherein the connector is adapted to releasably connect with the container.

3. The pressure sprayer of claim 1, wherein the chamber receives the pressurized fluid through a check valve that allows the pressurized fluid to flow from an outlet of the motor to the chamber but prevents the chemical solution from flowing from the chamber to the outlet of the motor.

4. The pressure sprayer of claim 1, wherein the motor is adapted to meter variable amounts of the chemical concentrate from a connected container.

5. The pressure sprayer of claim 1, further comprising at least one wheel that supports the pressure sprayer in rolling relation to a supporting surface, a tank for holding a fluid, and a pump powered by rotation of the at least one wheel to transfer fluid from the tank to the accumulator vessel, pressurizing the fluid in the accumulator vessel.

6. The pressure sprayer of claim 1, further comprising a mixture controller that operatively couples the first and second pistons, controlling the quantity of the chemical concentrate pumped by the second piston in response to movement of the first piston.

7. The pressure sprayer of claim 6, wherein the mixture controller can be adjusted to select the quantity of chemical concentrate to be pumped by the second piston in response to a given movement of the first piston.

8. The pressure sprayer of claim 7, wherein the mixture controller comprises a lever having a pivotal attachment point that is movable with respect to the lever to allow the location of pivotal attachment point to be selected to adjust the relative movement of each end of the lever with respect to the other end.

9. The pressure sprayer of claim 6, wherein the mixture controller comprises a rack and pinion system with the first and second pistons each operationally attached to first and second gear racks, respectively.

10. The pressure sprayer of claim 9, wherein the first and second gear racks are in operational contact with first and second transmission gears, respectively, arranged longitudinally on a common shaft and wherein the first and second transmission gears comprise a drive gear and a driven gear, respectively, wherein the driven gear is selectable through a gear transmission.

11. A pressure sprayer, comprising:

a housing having a motor, a mixture controller, an accumulator vessel to hold a first fluid under pressures and a container to hold a second fluid disposed therein, the motor comprising a first piston and a second piston;

wherein the first piston is adapted to be driven by the first fluid under pressure, the first piston is adapted to concurrently drive the second piston, the second piston is adapted to continuously pump a quantity of the second fluid, and the mixture controller operatively couples the first and second pistons for controlling the quantity of the second fluid pumped by the second piston.

12. The pressure sprayer of claim 11, wherein the first fluid in the accumulator vessel is pressurized by at least one of a fluid pump, a pressurized water system, or a pressurized air system.

13. The pressure sprayer of claim 12, wherein the at least one of the fluid pump, the pressurized water system, or the pressurized air system is disposed on or in the pressure sprayer.

14. The pressure sprayer of claim 11, wherein the mixture controller comprises a member operatively coupling the first piston to a plurality of second pistons.

15. The pressure sprayer of claim 14, wherein one of the plurality of second pistons is at least one of selectable or of a differing size from the other plurality of second pistons.

16. A pressure sprayer, comprising:

a housing supported by at least one wheel;

a tank for holding a fluid;

an accumulator vessel for holding a pressurized fluid;

a pump for pressurizing and advancing the fluid from the tank to the accumulator vessel in response to movement of the at least one wheel;

a container configured to hold a chemical concentrate;

a fluid motor in fluid communication with the accumulator vessel and the container, wherein the fluid motor is adapted to be driven by the pressurized fluid from the accumulator vessel and to pump the chemical concentrate from the container to a mixer adapted to mix the chemical concentrate with the pressurized fluid that drives the fluid motor to form a solution; and a nozzle adapted to spray the solution, wherein the fluid motor comprises a first piston that is mechanically linked to a second piston, and wherein the first piston is driven by the pressurized fluid from the accumulator vessel, the first piston concurrently drives the second piston, and the second piston, when so driven, pumps the chemical concentrate from the container.

17. The pressure sprayer of claim 16, wherein the fluid motor comprises a mixture controller adapted to entrain a variable amount of chemical concentrate.

18. The pressure sprayer of claim 16, wherein the container is replaceable.

19. The pressure sprayer of claim 16, wherein the mixer receives the pressurized fluid through a check valve that allows the pressurized fluid to flow from an outlet of the fluid motor to the mixer but prevents the chemical solution from flowing from the mixer to the outlet of the fluid motor.

* * * * *